US005277588A

United States Patent [19]

Lin

[11] Patent Number: 5,277,588

[45] Date of Patent: Jan. 11, 1994

[54] AUDIO EDUCATIONAL GAME

[76] Inventor: Wen-Tsung Lin, P.O. Box 74-9, Taipei, Taiwan

[21] Appl. No.: 66,222

[22] Filed: May 25, 1993

[51] Int. Cl.[5] ..... A63H 5/00

[52] U.S. Cl. ..... 434/335; 446/135; 446/397; 434/169

[58] Field of Search .....273/856, 237-239; 273/443; 273/454, 456; 446/135, 136, 397; 434/335, 338, 340, 341, 343, 327, 345, 156, 159, 168-171; 434/176

[56] References Cited

U.S. PATENT DOCUMENTS

| | | | |
|---|---|---|---|
| 3,114,547 | 12/1963 | Joslyn | 273/443 |
| 4,288,537 | 9/1981 | Knetzger | 434/169 |
| 4,820,233 | 4/1989 | Weiner | 446/397 X |
| 5,127,869 | 7/1992 | Hanzawa | 434/169 X |

*Primary Examiner*—Richard J. Apley
*Assistant Examiner*—Glenn E. Richman

[57] ABSTRACT

An audio educational game includes a housing having a peripheral circuit provided with a power source, a speaker or buzzer, and a plurality of trigger switches disposed on a fixed figure board on the housing with each trigger switch terminated at an access path on the fixed board; at least a replaceable recording insert having a talking integrated circuit mounted in the insert electrically connectable with the power source and the speaker of the peripheral circuit on the housing and having a plurality of trigger pins operatively connectable to the plurality of trigger switches provided on the housing when replaceably engaging the insert with a socket recessed in the housing, and a replaceable figure board adhered on the insert having a plurality of target figures drawn or printed on the replaceable figure board with each target figure correspondingly facing, or abutting to each access path formed or printed on the fixed figure board on the housing; and a magnetically attractive slide slidably movable on the fixed figure board and operatively slid as magnetically driven by a magnet, which is positioned beneath a bottom of the housing and manually moved on handled, to any desired access path to approximate a corresponding target figure shown on the replaceable figure board on the insert to close a specific trigger switch to trigger the talking integrated circuit for pronouncing a speech or words with respect to a meaning of the target figure shown on the replaceable figure board, thereby enhancing the playing and educational functions.

9 Claims, 6 Drawing Sheets

AUDIO EDUCATIONAL GAME

BACKGROUND OF THE INVENTION

A conventional audio educational kit as shown in FIG. 7 includes several figures F formed on a book-like structure each figure being operatively depressed to close a trigger switch S electrically connected to a speech integrated circuit IC, and plural explanation pages B respectively describing the relevant figures adjacent to the figures F, whereby upon a depression of a specific figure, the IC will pronounce a correct speech corresponding to the explanation page for educational purpose. However, it is just a simple depression-and-sounding device, lacking of vividness to spur a player's or learner's interest.

Another conventional educational game is designed to put all the figures F on the board as shown in FIG. 8, which may also cause the same defects as above-mentioned. Both conventional games as shown in FIGS. 7 and 8 are made as fixed types, which can not be replaceable for diversified educational choices, thereby decreasing a learner's interest and limiting its commercial value.

SUMMARY OF THE INVENTION

The object of the present invention is to provide an audio educational game including a housing having a peripheral circuit provided with a power source, a speaker or buzzer, and a plurality of trigger switches disposed on a fixed figure board on the housing with each trigger switch terminated at an access path on the fixed board; at least a replaceable recording insert having a talking integrated circuit mounted in the insert electrically connectable with the power source and the speaker of the peripheral circuit on the housing and having a plurality of trigger pins operatively connectable to the plurality of trigger switches provided on the housing when replaceably engaging the insert with a socket recessed in the housing, and a replaceable figure board adhered on the insert having a plurality of target figures drawn or printed on the replaceable figure board with each target figure correspondingly facing, or abutting to each access path formed or printed on the fixed figure board on the housing; and a magnetically attractive slide slidably movable on the fixed figure board and operatively slid as magnetically driven by a magnet, which is positioned beneath a bottom of the housing and manually moved on handled, to any desired access path to approximate a corresponding target figure shown on the replaceable figure board on the insert to close a specific trigger switch to trigger the talking integrated circuit for pronouncing a speech or words with respect to a meaning of the target figure shown on the replaceable figure board, thereby enhancing the playing and educational functions.

DETAILED DESCRIPTION

Figure 1:
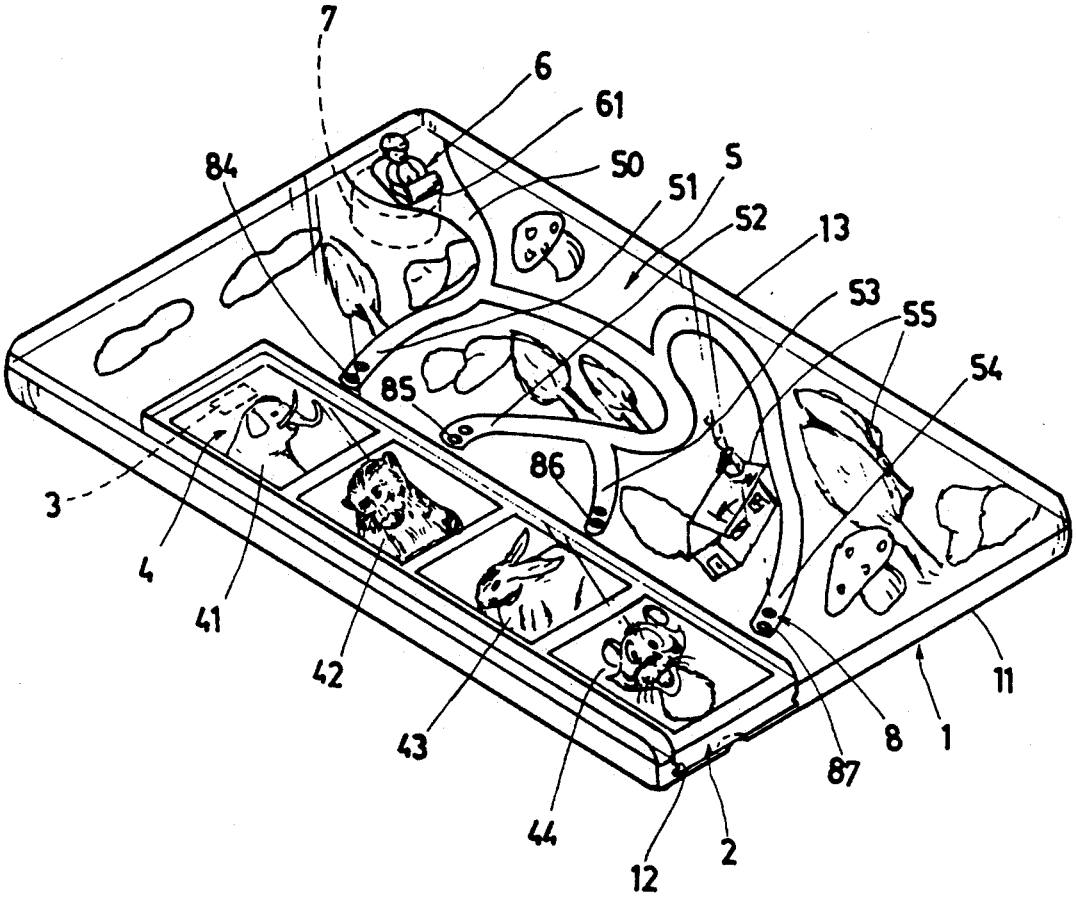
FIG. 1 is a perspective view of the present invention.

As shown in FIGS. 1-4, the present invention comprises: a housing 1, at least a replaceable recording insert 2 insertablly engageable with the housing 1, a talking integrated circuit 3 secured to the recording insert 2, a replaceable figure board 4 adhered on each recording insert 2, a fixed figure board 5 adhered on the housing 1 compatible with the replaceable figure board 4 on the recording insert 2, a magnetically attractive slide 6 slidably held on the fixed figure board 5, a magnet 7 positioned beneath a bottom of the housing 1 to magnetically drive the slide 6, and a peripheral circuit 8 provided in the housing 1 compatible with the talking integrated circuit 3.

The housing 1 is made of electrically insulative materials such as plastic materials, and includes: a housing base 11, a socket 12 recessed in the housing 1 for engaging the replaceable recording insert 2 therein having a receptacle portion 121 provided with a plurality of connectors of the peripheral circuit 8 secured in the housing 1, and a transparent cover 13 secured on a top portion of the housing 1 to shield the fixed figure board 5 and the magnetically attractive slide 6 in the housing 1.

Each replaceable recording insert 2 includes an insert casing 21 for securing a talking integrated circuit 3 therein and insertably engageable with the socket 12 recessed in the housing 1, and a plug portion 22 formed on an edge portion of the insert 2 having a plurality of pins of the talking integrated circuit 3 formed in the plug portion 22 to be connectable with the plurality of connectors of the peripheral circuit 8 in the housing 1.

Figure 2:
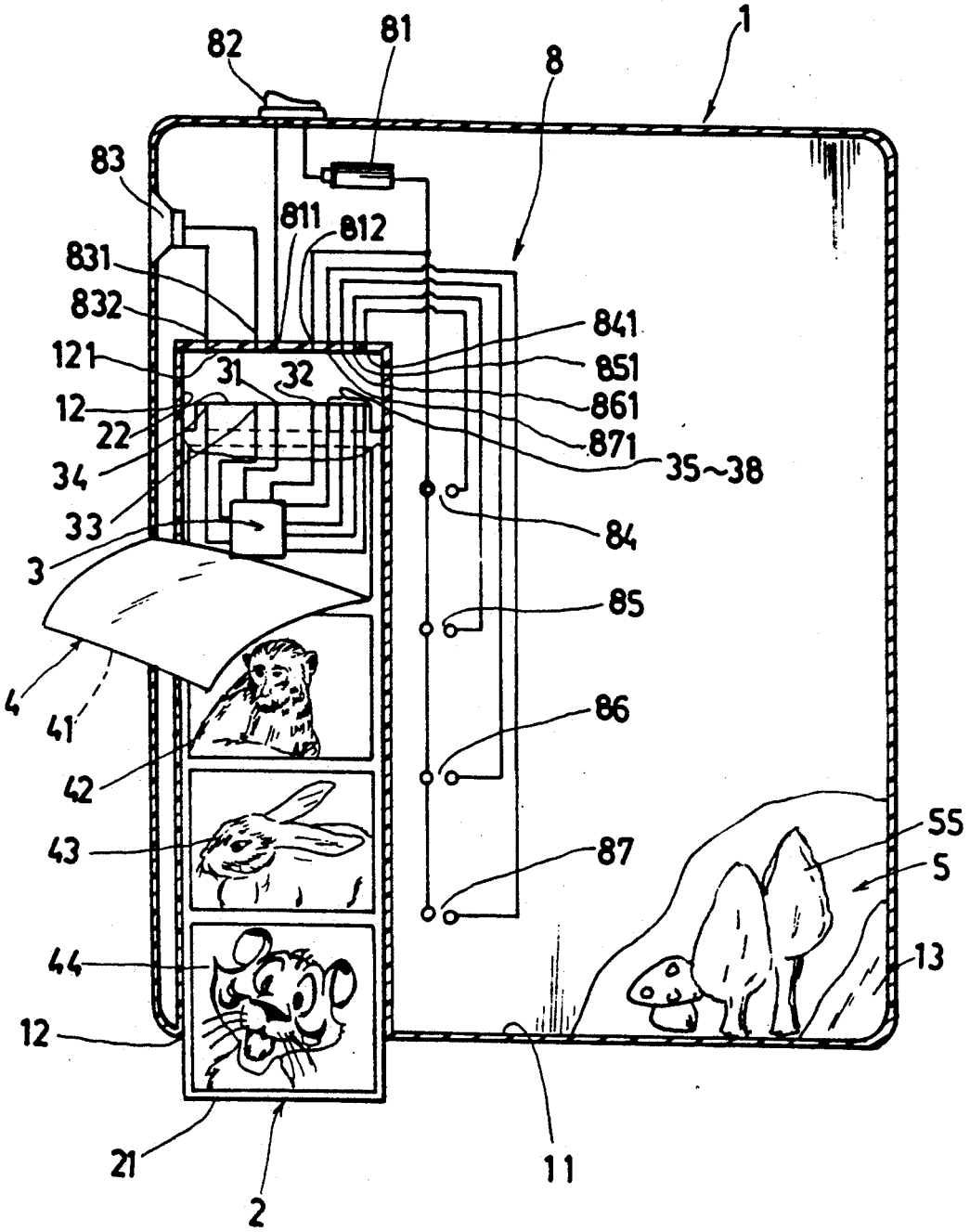
FIG. 2 is a top view partially cut-away illustration of the present invention.
Figure 3:
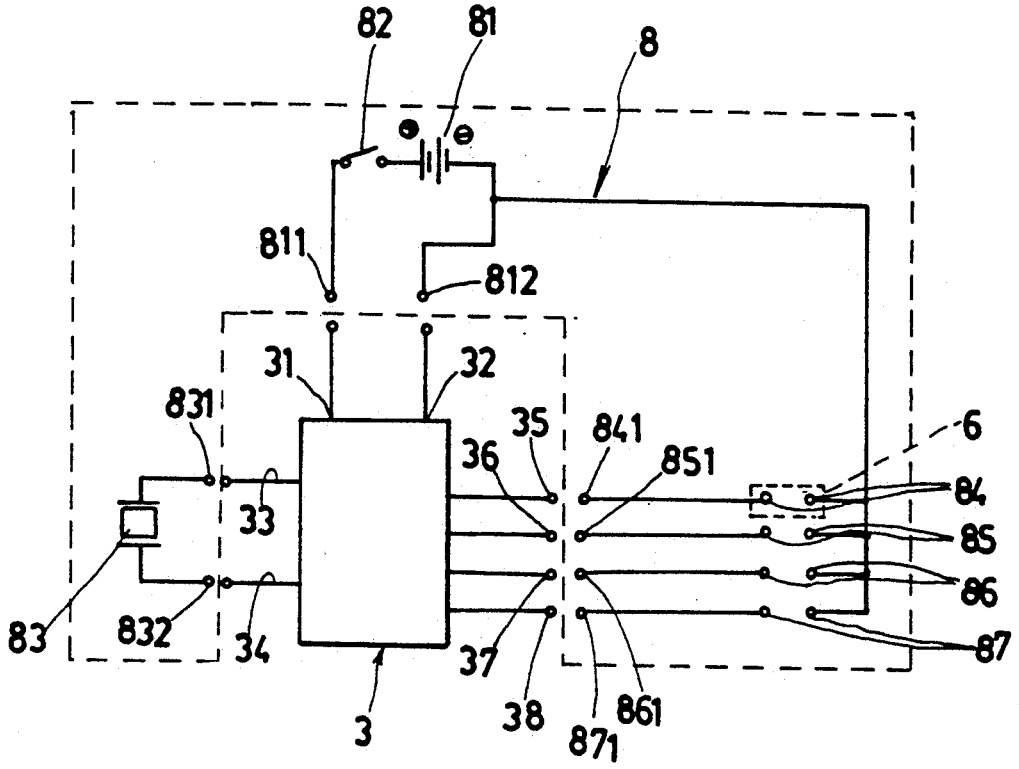
FIG. 3 shows an electronic circuit of the present invention.

The talking integrated circuit 3 as shown in FIGS. 2, 3 includes: a positive-pole pin 31 and a negative-pole pin 32 formed in the plug portion 22 of the insert 2 and respectively connectable to a positive-pole connector 811 and a negative-pole connector 812 of a power source 81 of the peripheral circuit 8 provided in the receptacle portion 121 of the housing 1, two speaker pins 33, 34 formed in the plug portion 22 and connectable to two speaker-wire connectors 831, 832 of the speaker 83 of the peripheral circuit 8 provided in the receptacle portion 121 of the housing 1, and a plurality of trigger pins 35, 36, 37, 38 formed in the plug portion 22 and connectable to a plurality of trigger-pin connectors 841, 851, 861, 871 of respective trigger switches 84, 85, 86, 87 of the peripheral circuit 8 with the trigger-pin connectors 841, 851, 861, 871 formed in the receptacle portion 121 of the housing 1; all the trigger pins 35 - 38 connected to the talking integrated circuit 3 which is pre-recorded with a plurality of categories of audible words or speech with each trigger pin operatively pronouncing a specific category of the pre-recorded words or speech corresponding to a specific meaning or indication of each target FIG. 41, 42, 43, 44 as shown on a replaceable figure board 4 adhered on the replaceable recording insert 2 when the magnetically attractive slide 6 is magnetically driven by the magnet 7 to operatively close a specific trigger switch 84 - 87 of the peripheral circuit 8 on the fixed figure board 5 in the housing 1.

The replaceable figure board 4 includes a plurality of target FIGS. 41, 42, 43, 44 juxtapositionally drawn or printed on the figure board 4 adhered on the recording insert 2 to be in cooperation with a decorative background FIG. 55 found in a fixed figure board 5 in the housing 1, each target figure denoting a meaning or indication corresponding to a specific category of audible words or speech as pre-recorded in the talking integrated circuit 3 and pronounced when closing a specific trigger switch 84–87 to trigger the trigger pin 35 38 of the talking integrated circuit 3.

As shown in the drawings, the target FIGS. 41 - 44 are respectively drawn as an elephant 41, a monkey 42, a rabbit 43, and a tiger 44 which are subjected to animals. The fixed figure board 5 adhered in the housing 1 may be drawn with a scenery or background such as a zoo, a garden or other features. The figures found on the board 4 on the insert 2 or on the board 5 in the housing 1 are not limited on this invention. As shown in FIG. 1, the four animals are walking on a land, whereas the other figures such as flying animals or different birds may be present on another replaceable insert 2 for diversified educational purpose.

The fixed figure board 5 includes: a main path 50 drawn, printed or formed on the fixed figure board 5 in the decorative background FIG. 55 which may be a scenery, a zoo, a garden, a forest or any other background features, adapted for a sliding movement of a magnetically attractive slide 6 on the fixed figure board 5 when magnetically attracted and driven by a magnet 7 positioned below the slide 6 or beneath a bottom of the housing 1, and a plurality of access paths 51, 52, 53, 54 respectively branched from the main path 50 and finally approximating or abutting to a plurality of respective target FIGS. 41, 42, 43, 44 on the replaceable figure board 4 adhered on the recording insert 2, having a trigger switch 84 - 87 formed on a terminal end portion of each access path 51 - 54 and operatively actuated by the magnetically attractive slide 6 when moved to close two contactors of each trigger switch 84 - 87 to trigger the talking integrated circuit 3 for producing audible voice to pronounce the meaning of the target figure.

For instance, if the slide 6 is moved to actuate the switch 84 before the target FIG. 41, an audio voice of "Elephant" will be sounded to match the elephant figure shown on the board 4 on the insert 2 for correcting, or proofing a precise pronounciation of the words of animals for enhancing a learner's interest and educational function. Therefore, learner such as a child may play the game as well as learn somethings by magnetically moving the slide 6 to get his or her desired selections.

The magnetically attractive slide 6 includes an electrically conductive bottom plate 61 slidably resting on the fixed figure board 5 in the housing 1, the bottom plate 61 of the slide 6 being made of magnetically attractive or ferrous materials to be attracted by the magnet 7 positioned below the slide 6 and beneath the housing 1.

Figure 4:
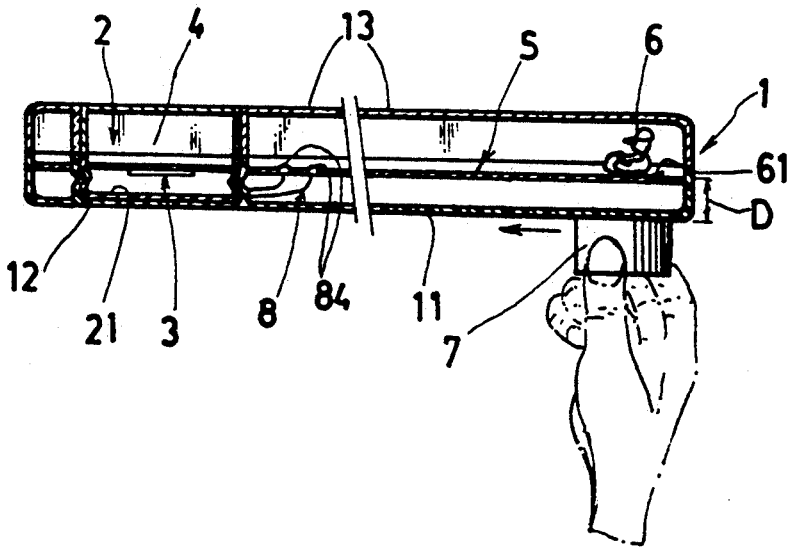
FIG. 4 is a sectional drawing of the present invention.

As shown in FIG. 4, the magnet 7 is positioned under the slide 6 by contacting the magnet 7 onto a bottom of the housing base 11 to define an effective distance D of the magnet force of the magnet 7 for effectively attracting the slide 6 by the magnet between the magnet 7 and the slide 6 as partitioned by the housing base 11 and the fixed figure board 5, with any distance longer than such an effective distance D, the magnet 7 may weaken its magnetic force, not effectively attracting the slide 6.

The present invention can spur a child leaner to play the game interestingly, and to learn something simultaneously. The paths can be optionally chosen and the inserts may be replaceable to diversify the playing methods, thereby causing vividness of the game to be superior to a conventional game of fixed type.

Figure 5:
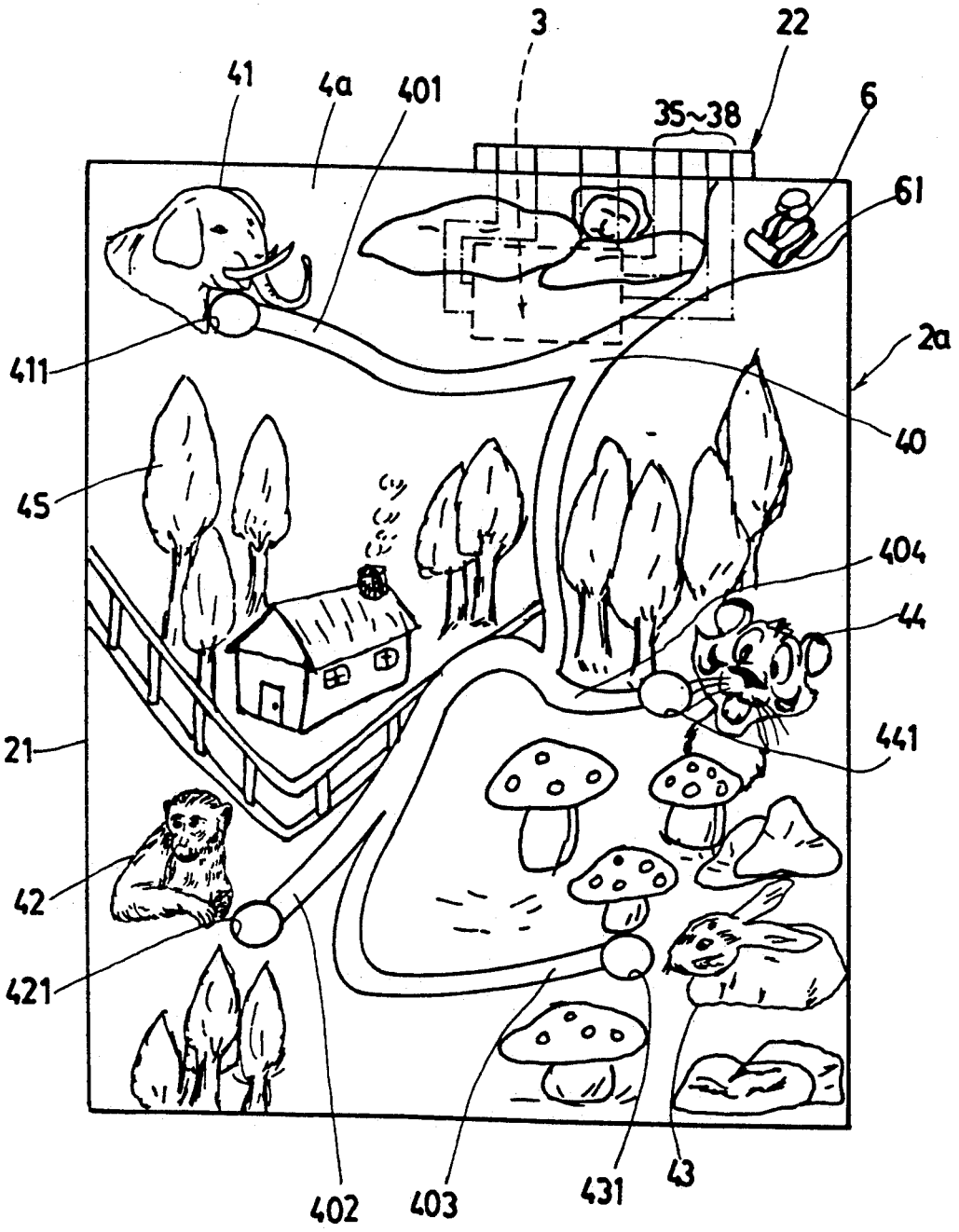
FIG. 5 shows a replaceable recording insert of another preferred embodiment of the present invention.
Figure 6:
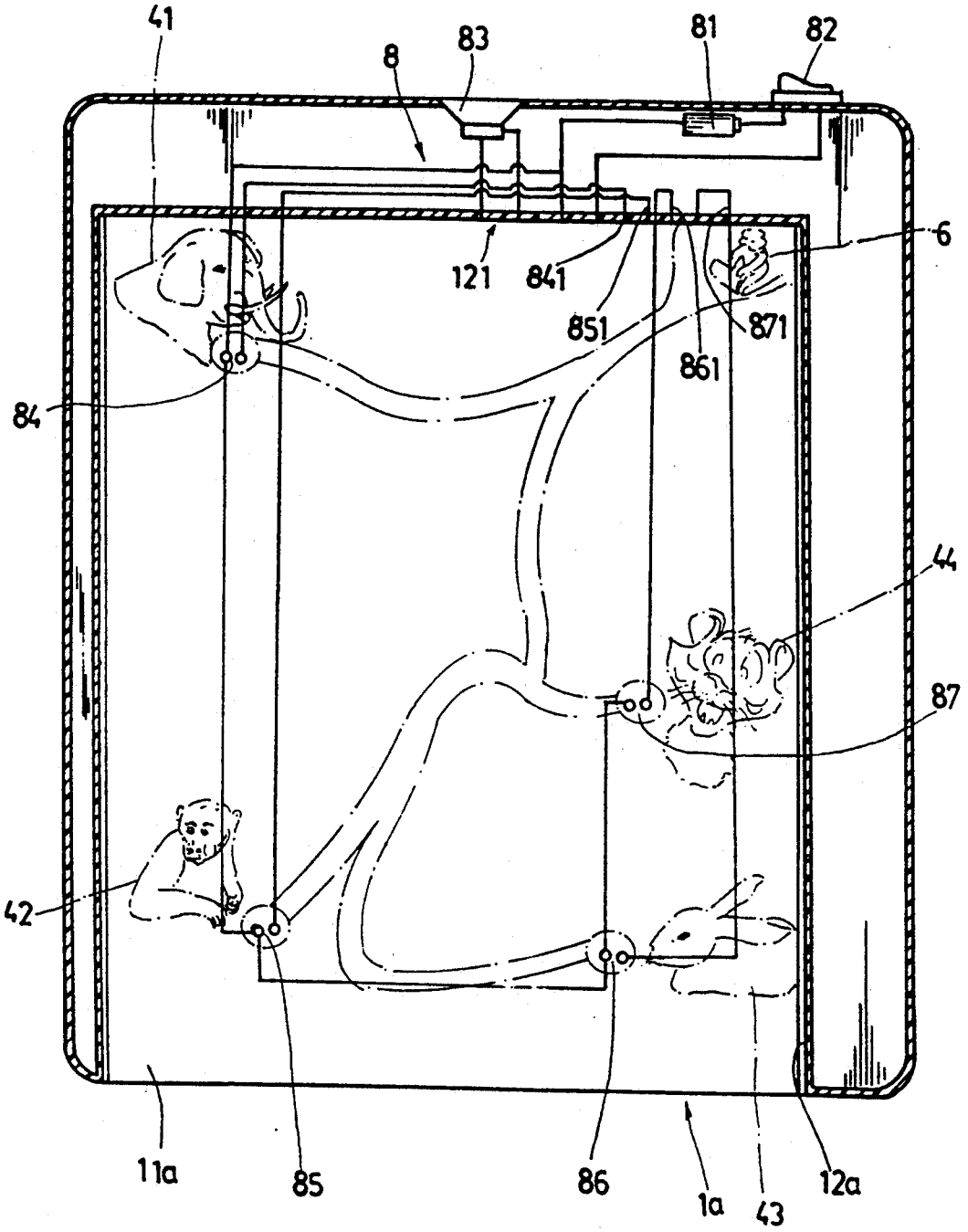
FIG. 6 shows a housing adapted for the recording insert as shown in FIG. 5 in accordance with the present invention.

As shown in FIGS. 5–6, the insert **2*a* and the replaceable figure board 4*a* may be made larger in size to almost occupy an area of the housing 1*a* of which the socket 12*a* for engaging the larger insert 2*a* is also made larger. The fixed figure board 5** as aforementioned is now eliminated.

Figure 7:
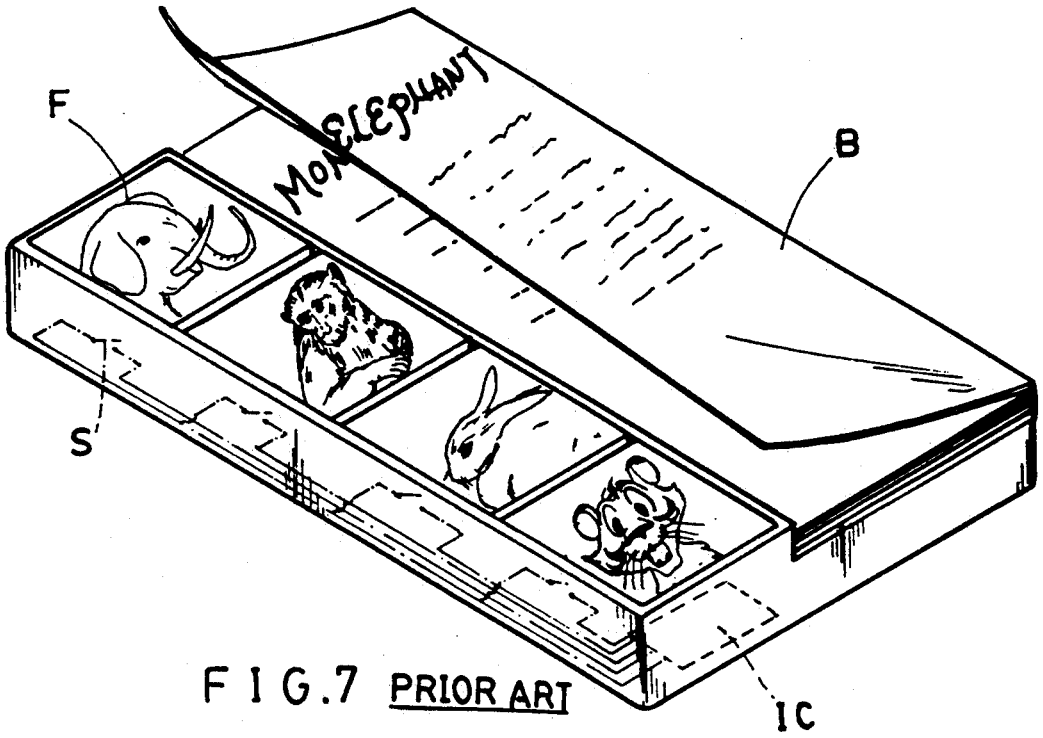
FIG.7 PRIOR ART
FIG. 7 shows a first prior art of a conventional educational game.
Figure 8:
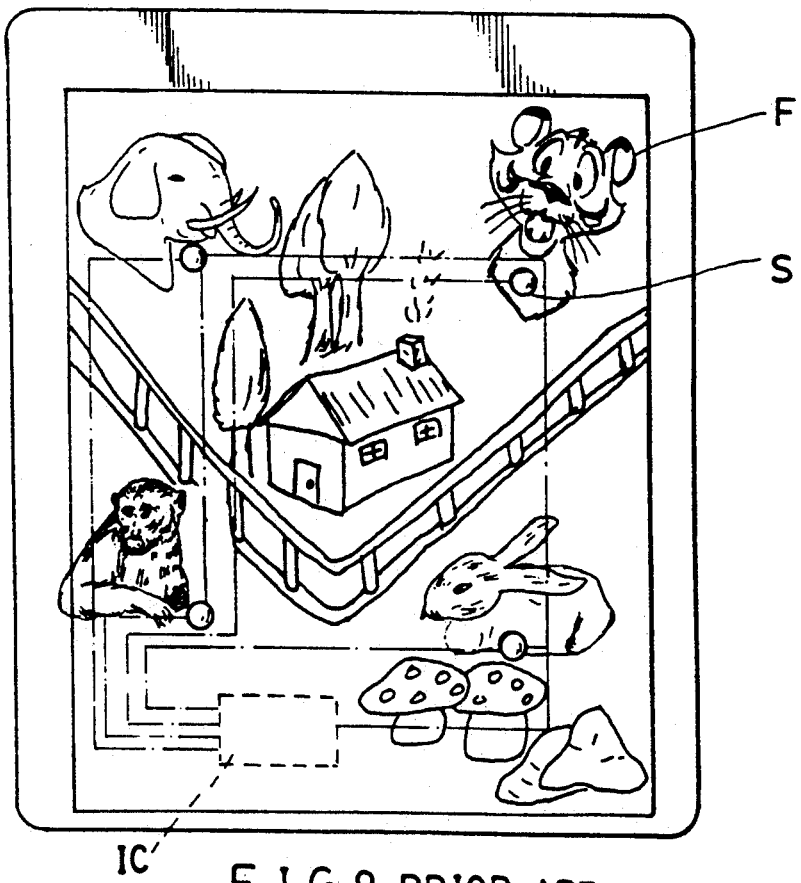
FIG.8 PRIOR ART
FIG. 8 shows a second prior art of another conventional educational game.

The replaceable figure board **4*a* includes a plurality of access paths 401, 402, 403, 404 irregularly branched from a main path 40 formed on the replaceable figure board 4*a*, each access path having a switch hole 411, 421, 431, 441 respectively punched in the replaceable figure board 4*a* to reveal each trigger switch 84, 85, 86, 87 irregularly formed on a housing bed 11*a* confined in the socket 12*a* of the housing 1*a*, whereby upon an insertion of the replaceable recording insert 2*a* into the socket 12*a* of the housing 1*a* and upon a magnetically driving of the slide 6 on the replaceable figure board 4*a* to a switch hole 411, 421, 431, 441 of an access path 401, 402, 403, 404 to close a trigger switch 84, 85, 86, 87 of the talking integrated circuit 3 for producing audio voice corresponding to the target FIG. 41, 42, 43, 44, to which each access path 401, 402, 403, 404 is directed and approximated. The modification in FIG. 7, 8 is irregularly drawn for the features and figures on the board 4*a*** for more interesting use.

I claim:

1. An audio educational game comprising:

a housing having a peripheral circuit provided with a power source, a speaker, and a plurality of trigger switches disposed on a fixed figure board on the housing with each said trigger switch terminated at an access path on the fixed board; at least a replaceable recording insert having a talking integrated circuit mounted in the insert electrically connectable to the power source and the speaker of the peripheral circuit on the housing and having a plurality of trigger pins operatively connectable to the plurality of trigger switches provided on the housing when replaceably engaging the insert with a socket recessed in the housing, and a replaceable figure board adhered on the insert having a plurality of target figures printed on the replaceable figure board with each said target figure correspondingly abutting to each said access path formed on the fixed figure board on the housing; and a magnetically attractive slide slidably movable on the fixed figure board and operatively slid as magnetically driven by a magnet, which is positioned beneath a bottom of the housing, to a desired access path to approximate a corresponding target figure shown on the replaceable figure board on the insert to close a specific trigger switch to trigger the talking integrated circuit for pronouncing an audible voice with respect to a meaning of the target figure shown on the replaceable figure board.

2. An audio educational game according to claim 1, wherein said housing is made of electrically insulative materials, and includes:

a housing base, said socket recessed in the housing base for engaging the replaceable recording insert therein having a receptacle portion provided with a plurality of connectors of the peripheral circuit secured in the housing, and a transparent cover secured on a top portion of the housing to shield the fixed figure board and the magnetically attractive slide in the housing.

3. An audio educational game according to claim 2, wherein each said replaceable recording insert includes an insert casing for securing a talking integrated circuit therein and insertably engageable with the socket recessed in the housing, and a plug portion formed on an edge portion of the insert having a plurality of pins of the talking integrated circuit formed in the plug portion to be connectable to the plurality of connectors of the peripheral circuit in the housing.

4. An audio educational game according to claim 3, wherein said talking integrated circuit includes:

a positive-pole pin and a negative-pole pin formed in the plug portion of the insert and respectively connectable to a positive-pole connector and a negative-pole connector of a power source of the peripheral circuit provided in the receptacle portion of the housing, two speaker pins formed in the plug portion and connectable to two speaker-wire connectors of the speaker of the peripheral circuit provided in the receptacle portion of the housing, and a plurality of trigger pins formed in the plug portion and connectable to a plurality of trigger-pin connectors of respective trigger switches of the peripheral circuit with the trigger-pin connectors formed in the receptacle portion of the housing; all said trigger pins connected to the talking integrated circuit pre-recorded with a plurality of categories of audio categories of audio voices with each said trigger pin operatively pronouncing a specific category of audible voice corresponding to a specific meaning of each said target figure on a replaceable figure board adhered on the replaceable recording insert when the magnetically attractive slide is magnetically driven by the magnet to operatively close a specific trigger switch of the peripheral circuit on the fixed figure board in the housing.

5. An audio educational game according to claim 4, wherein said replaceable figure board includes a plurality of said target figures juxtapositionally printed on the replaceable figure board adhered on the recording insert to be in cooperation with a decorative background figure formed in a fixed figure board in the housing, each said target figure denoting a meaning corresponding to a specific category of audible voice as pre-recorded in the talking integrated circuit and pronounced when closing a specific trigger switch to trigger the trigger pin of the talking integrated circuit.

6. An audio educational game according to claim 5, wherein said fixed figure board includes: a main path formed on the fixed figure board in the decorative background figure for a sliding movement of a magnetically attractive slide on the fixed figure board when magnetically attracted and driven by a magnet positioned below the slide and beneath a bottom of the housing, and a plurality of access paths respectively branched from the main path and finally approximating to a plurality of respective target figures on the replaceable figure board adhered on the recording insert, having a trigger switch formed on a terminal end portion of each said access path and operatively actuated by the magnetically attractive slide when moved to close two contactors of each said trigger switch to trigger the talking integrated circuit for producing an audible voice to pronounce the meaning of the target figure.

7. An audio educational game according to claim 6, wherein said magnetically attractive slide includes an electrically conductive bottom plate slidably laid on the fixed figure board in the housing, the bottom plate of the slide being made of magnetically attractive materials to be attracted by the magnet positioned below the slide and beneath the housing.

8. An audio educational game according to claim 7, wherein said magnet is positioned under the slide by contacting the magnet onto a bottom of the housing base to define an effective distance of a magnetic force of the magnet for effectively attracting the slide by the magnet between the magnet and the slide as partitioned by a housing base and the fixed figure board.

9. An audio educational game comprising:

a housing having a peripheral circuit provided with a power source, a speaker, and a plurality of trigger switches disposed on a fixed housing bed of the housing; at least a replaceable recording insert having a talking integrated circuit mounted in the insert electrically connectable with the power source and the speaker of the peripheral circuit on the housing and having a plurality of trigger pins operatively connectable to the plurality of trigger switches provided on the housing when replaceably engaging the insert with a socket recessed in the housing, and a replaceable figure board adhered on the insert having a plurality of target figures printed on the replaceable figure board with each said target figure correspondingly abutting to an access path formed on the replaceable figure board inserted onto the housing; and a magnetically attractive slide slidably movable on the replaceable figure board embedded on the housing and operatively slid as magnetically driven by a magnet, which is positioned beneath a bottom of the housing, to approximate a corresponding target figure shown on the replaceable figure board on the insert to close a specific trigger switch to trigger the talking integrated circuit for pronouncing an audible voice with respect to a meaning of the target figure shown on the replaceable figure board; and said replaceable figure board including a plurality of access paths irregularly branched from a main path formed on the replaceable figure board, each said access path having a switch hole respectively punched in the replaceable figure board to reveal each said trigger switch irregularly formed on the housing bed confined in the socket of the housing, whereby upon an insertion of the replaceable recording insert into the socket of the housing and upon a magnetically driving of the slide on the replaceable figure board to a switch hole of one said access path to close one said trigger switch of the talking integrated circuit, an audible voice corresponding to a meaning shown on the target figure will be produced, when said slide is directed in said access path to approximate each said target figure.

* * * * *